United States Patent [19]

Schrader

[11] Patent Number: 5,012,850

[45] Date of Patent: May 7, 1991

[54] VALANCE CLIP

[75] Inventor: James E. Schrader, Gilford, Canada

[73] Assignee: Kwik Clip, Barrie, Canada

[21] Appl. No.: 357,260

[22] Filed: May 26, 1989

[51] Int. Cl.[5] ..... E06B 9/00

[52] U.S. Cl. ..... 160/38; 160/178.1; 160/902

[58] Field of Search ..... 160/38, 39, 178.1, 902, 160/19, 176.1, 168.1, 405; 248/251, 273, 231.8, 316.7; 16/94 R, 95 R, 87.4 R, 94 D, 95 D; 24/67.11

[56] References Cited

U.S. PATENT DOCUMENTS

| | | | |
|---|---|---|---|
| 202,993 | 4/1878 | Closser . | |
| 1,602,341 | 10/1926 | Day . | |
| 1,668,429 | 5/1928 | Simon | 24/67.11 |
| 2,130,546 | 9/1938 | Hovey | 189/35 |
| 2,204,937 | 6/1940 | Larrison | 156/17 |
| 2,293,662 | 8/1942 | Richardson | 160/19 |
| 2,345,419 | 3/1944 | Olson | 189/35 |
| 2,808,222 | 10/1957 | Wassyng et al. | 160/19 X |
| 3,136,357 | 6/1964 | Lorentzen et al. | 160/178.1 |
| 3,983,600 | 10/1976 | Smith | 16/87 R |
| 4,079,770 | 3/1978 | Woodle | 160/39 X |
| 4,114,233 | 9/1978 | Hamilton | 16/95 R |
| 4,187,658 | 2/1980 | Reinwall, Jr. | 52/489 |
| 4,254,813 | 3/1981 | Vecchiarelli | 160/19 |
| 4,329,078 | 5/1982 | Crates et al. | 403/316 |
| 4,341,254 | 7/1982 | Shaller et al. | 160/172 |
| 4,399,856 | 8/1983 | Anderson | 160/39 |
| 4,662,421 | 5/1987 | Basmadji et al. | 160/38 |
| 4,840,216 | 6/1989 | John | 160/38 X |
| 4,845,807 | 7/1989 | Rooney | 16/94 R |

*Primary Examiner*—David M. Purol

*Attorney, Agent, or Firm*—Weldon F. Green

[57] ABSTRACT

A valance clip for securing a valance to a vertical blind assembly. The vertical blind assembly comprising a track for supporting the vertical blinds, and track or ceiling clips for securing the track to a suitable surface, such as a ceiling. The valance clip including a base for securing the clip to the vertical blind assembly, and an elongated portion extending outwardly from the base, and preferably spring biased to urge the elongated portion of the clip against the ceiling. The valance is secured between the spring biased elongated portion of the valance clip and the ceiling.

14 Claims, 2 Drawing Sheets

VALANCE CLIP

FIELD INVENTION

Figure 1:
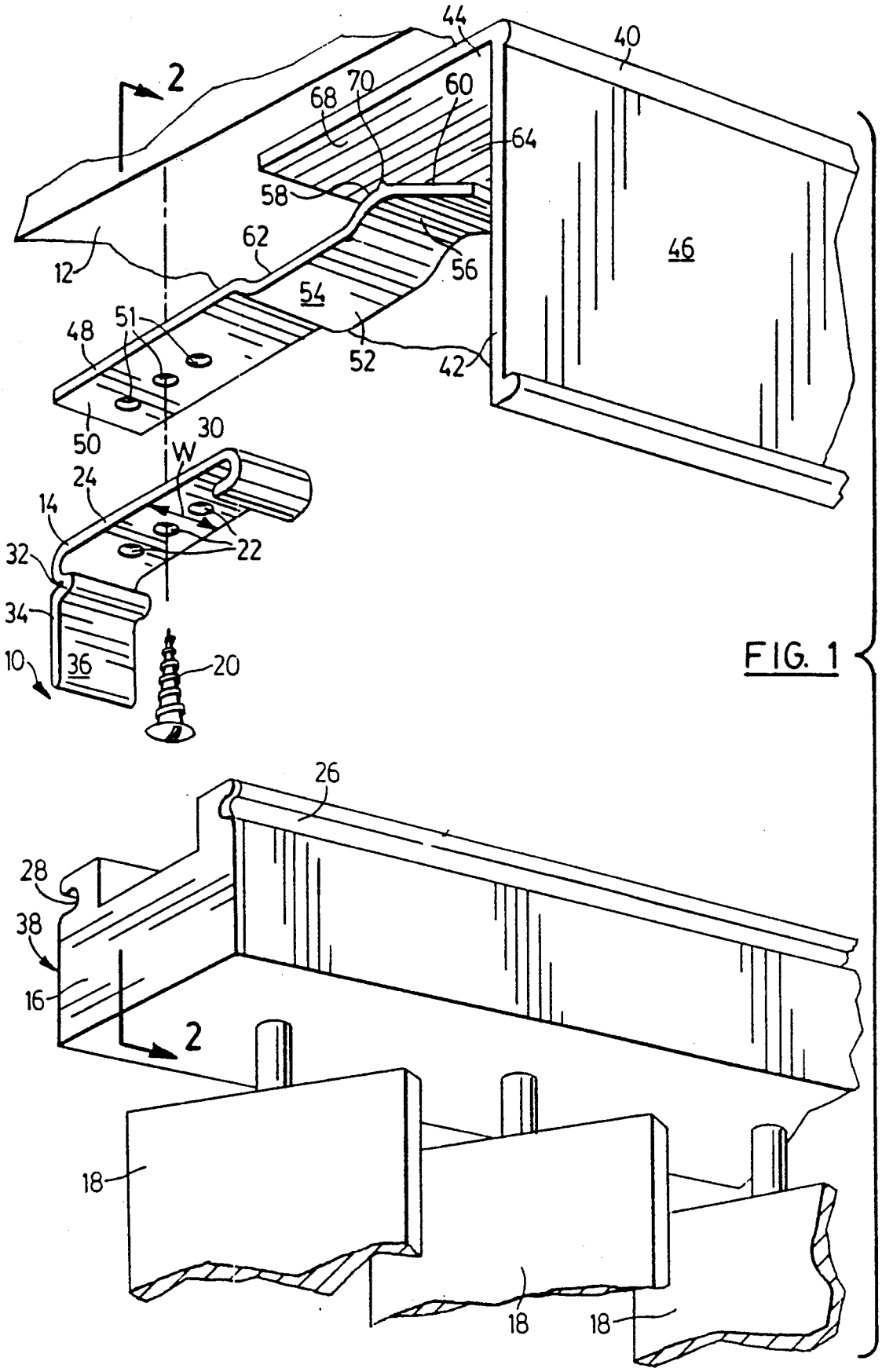

This invention relates to improvements in securing valance to a vertical blind assembly.

More particularly, this invention relates to a valance clip which is secured to a vertical blind assembly and is biased so that the valance is secured between the clip and a suitable brace means.

BACKGROUND TO THE INVENTION

Vertical blind assemblies of the type under consideration typically present a plurality of spaced apart track or ceiling clips aligned in parallel relation to one another and secured to the ceiling to which the vertical blind assembly is attached. An elongate track for supporting the vertical blinds is then secured to the track or ceiling clips.

A valance is then secured to the vertical blind assembly to hide from view the track or ceiling clips and the track of the vertical blind assembly. An attractive valance finishes the look of a vertical blind assembly.

A typical valance of the type under consideration comprises two substantially longitudinally rectilinear panels positioned at 90° to one another. One panel is oriented substantially vertically; the outer face of which can be decorated with an attractive pattern, if desired, to finish the appearance of the vertical blind assembly. The second panel extends rearwardly substantially 90° to the vertical panel and is adapted along its rearmost edge to be secured to the vertical blind assembly. It can be appreciated that in order to secure the valance to the vertical blind assembly the second panel of the valance is cut out at longitudinally spaced apart intervals therealong at positions corresponding to the positions of the track or ceiling clips. The cut-outs have a perimetral configuration substantially equal to that of the track or ceiling clips; the width of the cut-outs being slightly larger than the width of the track or ceiling clips so that the cut-outs substantially embrace the track or ceiling clips. The valance is then secured to the vertical blind assembly by fitting same between the track and the ceiling around the track or ceiling clips so that the cut-outs substantially embrace the track or ceiling clips; the valance is supported in snug fit from below by the track of the vertical blind assembly and from above by the ceiling.

It can be appreciated that this is a time consuming task; the measuring and placing of the cut-outs on the valance requires extra labour which is both time consuming and costly.

Moreover, since the valance is supported snugly between the track of the vertical blind assembly and the ceiling there is little tolerance for unevenness in the track or ceiling. Particularly, in ceilings constructed with stucco it is usually required that the stucco be scraped away where the valance is to be secured.

Again, this is a task which requires extra labour that is both time consuming and costly.

Further, it can be appreciated that if the track with the vertical blinds or the track or ceiling clips of the vertical blind assembly have to be, for example, for repair, then the valance will also have to be removed; the valance is supported from below by the track of the vertical blind assembly. Since the valance itself might not need repair or replacing the removing of the valance is an unnecessary expenditure of both time and labour.

One solution to the problem at hand was presented by U.S. Pat. No. 4,254,813. In this patent the valance is secured to a downwardly extending arm of an L-shaped bracket. The L-shaped bracket is adapted to be retained in sliding fit within a clip which includes therein channel formations therein for receiving one end of the bracket.

This solution presented by this patent, however, is time consuming and requires skilled labour in placing and fastening the L-shaped bracket to the valance at longitudinally spaced apart locations therealong in such a manner and disposition that the L-shaped brackets align with the positions of the channel formations of the clips to which the track is secured.

The valance clip of the present invention overcomes the problems of the prior art without requiring unnecessary labour - saving both time and cost in installing valance to a vertical blind assembly.

OBJECTS OF THE INVENTION

It is therefore a principal object of this invention to provide a valance clip for vertical blind assemblies wherein the valance can be secured to the assemoly with minimum time and labour expended.

Further, it is an object of this invention that the effect of unevenness in ceilings during installation be minimized.

Moreover, it is an object of this invention to allow repairs to the track or the track or ceiling clips of the vertical blind assembly without requiring the removal of the valance.

It is also an object of this invention that the valance be secured so that later removal of same is possible, without removal of the vertical blind assembly, should the pattern or ornamentation on the vertical panel of the valance be desired to be changed.

FEATURES OF THE INVENTION

One important feature of this invention resides in providing a valance clip for a vertical blind assembly wherein the clip is biased so as to urge a portion of the clip against a brace means securing the valance between the clip and the brace means.

More particularly, it is a feature of this invention to provide a valance clip comprising a base for securing the clip to the vertical blind assembly, and an elongate portion extending from the base. The elongate portion is preferably spring biased for urging same in engagement with the brace means, securing the valance to the vertical blind assembly.

Further, it is preferred, though not limited to, that the brace means comprises the ceiling. The valance clip is positioned below the ceiling for supporting the valance between the spring biased elongate portion of the clip and the ceiling.

The vertical blind assembly is also preferably secured to the ceiling.

It is also a feature of this invention to secure the valance clip between the track portion of the vertical blind assembly and the brace means or ceiling. In particular, the valance clip is secured between track or ceiling clips which hold the track in place, and the brace means.

Moreover, it is a feature of this invention that the elongate portion of the valance clip be provided with a transversely extending ridge for providing extra grip in securing the valance between the spring biased elongate portion of the clip and the brace means or ceiling.

Further, it is also a feature of this invention to provide a method for securing a valance to a vertical blind assembly comprising a brace means. The method comprising the steps of first securing the valance clips to the vertical blind assembly, and preferably between the track or ceiling clips of the vertical blind assembly and the brace means or ceiling. The valance is then secured between the biased elongate portion of the valance clip and the brace means or ceiling.

DESCRIPTION OF THE INVENTION

Figure 2:
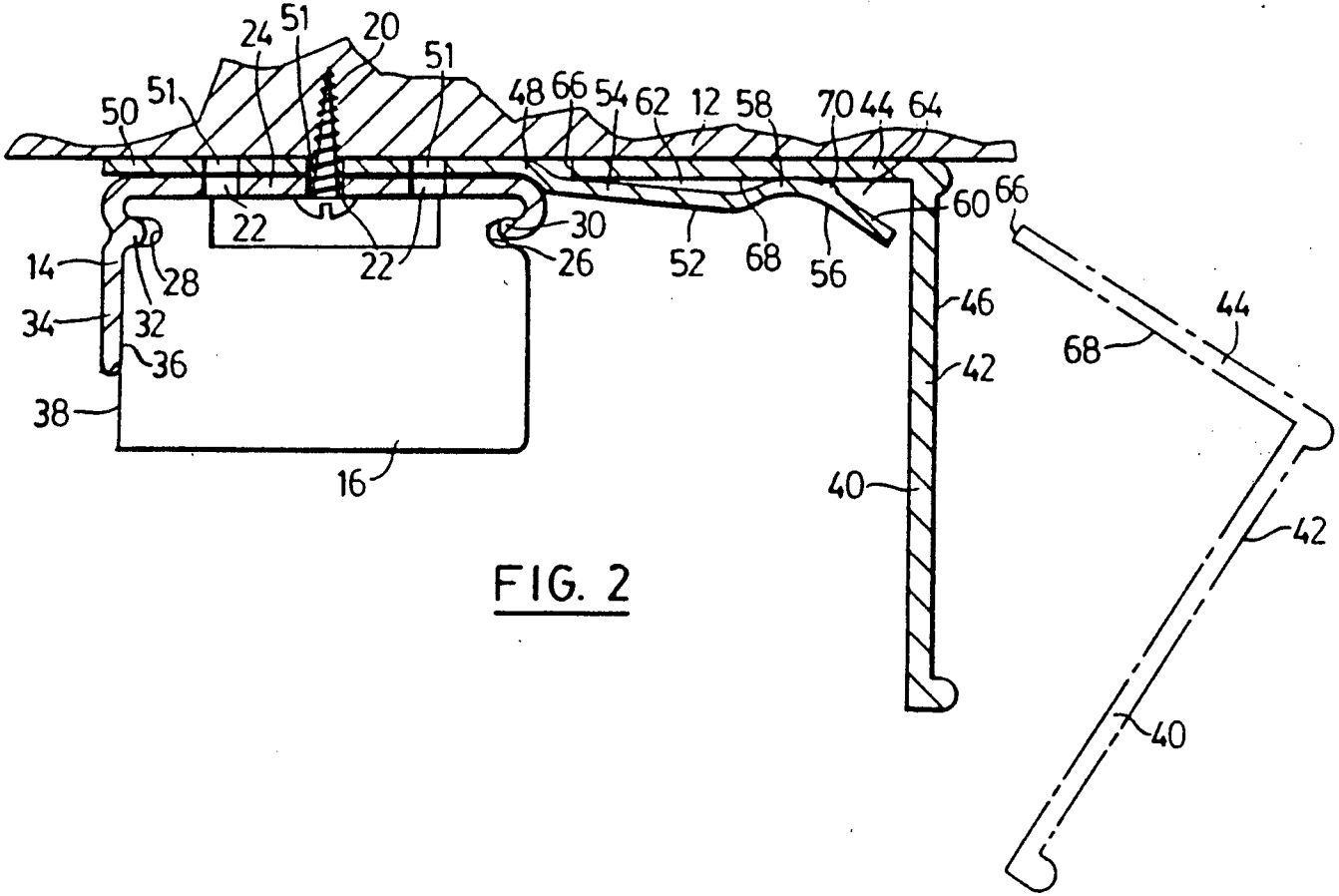

These and other objects and features of the invention will be perceived from the following description of the preferred embodiment of the invention which is to be read in conjunction with the sheets of drawings illustrating same, wherein:

FIG. 1 is a perspective exploded view of a vertical blind assembly constructed in accordance with the invention illustrating the various components of the invention; and FIG. 2 is a cross-sectional view taken along lines 2—2 of FIG. 1 illustrating the vertical blind assembly in assembled condition.

The vertical blind assembly 10 of this invention is basically illustrated in exploded view in FIG. 1 and comprises a brace means, which in the preferred embodiment is ceiling 12, track or ceiling clips 14, and track 16 for supporting vertical blinds 18.

The vertical blind assembly is secured to ceiling 12 by means of track or ceiling clips 14. Track 16, which pivotally supports vertical blinds 18, is releasably secured to track or ceiling clips 14, as will hereinafter be explained.

To install vertical blind assemblies of the type under consideration a series of spaced-apart like track or ceiling clips 14 are positioned along the length of ceiling 12 from which the vertical blind assembly is supported; these track or ceiling clips provide support for track 16 which, in turn, pivotally supports vertical blinds 18. In the prior art the vertical blind assembly, which comprises ceiling 12, track or ceiling clips 14, and track 16 for pivotally supporting vertical blinds 18, is installed as follows.

Screw 20 is inserted through one of openings 22 found in base 24 of track or ceiling clips 14 for securing track or ceiling clips 14 to ceiling 12. Alternatively, a plurality of similar screws could be inserted through each of openings 22 in base 24 of track or ceiling clips 14 to provide extra support for the assembly.

Track 16 is then secured in position by aligning front and rear grooves 26, 28, respectively, of track 16 with front and rear detents 30, 32, respectively, of track or ceiling clips 14. Front groove 26 of track 16 is aligned with respective front detents 30 of track or ceiling clips 14. Upon aligning the respective front groove 26 of track 16 and front detents 30 of track or ceiling clips 14 rear groove 28 of track 16 is snapped in place with respective rear detents 32 of track or ceiling clips 14. In this manner track or ceiling clips 14 secure track 16 in place, which, in turn, supports vertical blinds 18.

To provide added support to track 16, track or ceiling clips 14 are typically provided with a substantially vertically depending extension 34. Extension 34 presents a surface 36 which is adapted to abut against rear surface 38 of track 16.

Valance 40 is then provided to finish the appearance of the vertical blind assembly.

In particular, valance 40 comprises two rectangular longitudinally extending panels 42, and 44, coterminous along their common border. The first panel 42 extends substantially vertically, and, as particularly shown in FIG. 2, substantially conceals from view track or ceiling clips 14 and track 16 of the vertical blind assembly. The front facing 46 of panel 42 can be suitably decorated to provide a finished appearance to the assembly.

Second panel 44 of valance 40 is disposed generally 90° to first panel 42, and extends substantially horizontally rearwardly therefrom.

It can be appreciated that in prior art proposals second panel 44 is inserted between ceiling 12 and track 16. In order to fit panel 44 of valance 40 around track or ceiling clips 14 cut outs (not shown) are required at longitudinally spaced apart intervals therealong at positions corresponding to the positions of track or ceiling clips 14. The cut outs have a perimetral configuration and extent substantially equal to that of track or ceiling clips 14—particularly the width of the cut outs being slightly larger than the width W of track or ceiling clips 14.

As mentioned previously, providing cut outs to panel 44 of valance 40 is a time consuming and labour intensive task.

Further, by inserting panel 44 of valance 40 between ceiling 12 and track or ceiling clip 16 a snug fit is required so that valance 40 does not become loose and accidentally dislodge or fall away from the assembly. Consequently, there is little tolerance for unevenness of the supporting surfaces of either ceiling 12 or track 16. This problem is particularly appreciated when securing valance to vertical blind assemblies secured to ceilings finished with stucco.

The problems presented above are overcome by the present invention by providing a valance clip 48 which is secured to the vertical blind assembly between ceiling 12 and track or ceiling clips 14, all as best illustrated in FIG. 1. In the preferred embodiment valance clip 48 is constructed of a suitable metal, and preferably 1070 spring steel.

In particular, valance clip 48 includes a base 50 of substantially the same size and configuration as base portion 24 of track or ceiling clips 14, including openings 51 corresponding to openings 22 of base portion 24 of track or ceiling clips 14 for receiving therethrough screw 20. An elongated portion 52 extends from base 50 of valance clip 48 and comprises an elongated portion 54, offset from base 50, followed by a curved portion 56 comprising a base 58 and a terminal end portion 60. The offset elongate portion 54 and curved portion 56 are so arranged to provide a spring biased tension to elongated portion 52 of valance clip 48, particularly when used in combination with a suitable brace means, such as, in the preferred embodiment ceiling 12. Further, by arranging offset elongate portion 54 and curved portion 56 as illustrated in the figures it can be appreciated that the direction of the spring bias urges base 58 of curved portion 56 of elongated portion 52 of valance clip 48 against ceiling 12, when the valance clip is operably positioned, as will hereinafter be explained.

To assemble the vertical blind assembly incorporating valance clip 48, track or ceiling clips 14 are secured to ceiling 12 as described above in parallel spaced-apart relation to one another. Now, however, a plurality of valance clips 48 are secured to the assembly by inserting screw 20 through one of openings 22 of base 24 of track or ceiling clips 14 and through the corresponding opening 51 of base 50 of valance clip 48; therefore valance clips 48 are secured between track or ceiling clips 14 and ceiling 12 with each of elongate portions 52 of the valance clips extending outwardly from the assembly in the same direction.

As best illustrated in FIG. 2, when valance clip 48 is secured between track or ceiling clips 14 and ceiling 12 the relationship between offset elongated portion 54 of valance clip 48 and ceiling 12 defines a recess 62 which receives second panel 44 of valance 40. Further, terminal end 60 of curved portion 56 defines a second recess 64 which acts as a guide facilitating placement of valance 40 as will be hereinafter described.

In order to finish the assembly valance 40 is secured in the manner best illustrated in FIG. 2. In particular, second panel 44 of valance 40 is inserted within second recess 64 defined by terminal end 60 and more particularly defined between the terminal end and ceiling 12. By pushing panel 44 of valance 40 against terminal end 60 leading edge 66 of panel 44 separates base 58 of curved portion 56 of elongate portion 52 of valance clip 48 away from ceiling 12 creating a gap therebetween. Panel 44 of valance 40 is then pushed through the gap created and into recess 62.

The spring biasing of elongate portion 52 of valance clip 48 urges base 58 of curved portion 56 of elongate portion 52 of valance clip 48 against underside 68 of second panel 44 of valance 40 securing the panel and hence the valance between the elongate portion 52 of valance clip 48 and ceiling 12.

It can be appreciated ceiling 12 acts as a brace member providing support for panel 44 of valance 40 on one side while the underside of panel 44 is supported by elongated portion 52 which is urged against the valance panel through the spring biased action of valance clip 48.

Finally, should added grip be desired a ridge 70 can be provided extending transversely across the outer surface of base 58 of curved portion 56.

It can be appreciated that since valance 40 is not supported snugly between track 16 of the vertical blind assembly and ceiling 12, as in the prior art, but rather between the spring biased portion of valance clip 48 and ceiling 12 there is greater tolerance for unevenness in the ceiling. Further, unevenness in the track does not affect the placing of the valance when using valance clip 48.

Further, it can be appreciated that if track 16 with vertical blinds 18 or track or ceiling clips 14 of the vertical blind assembly have to be removed, for example, for repair, then valance 40 need not also be removed. The valance is solely supported from below by the spring biased portion of the valance clip and from above by the ceiling; valance clip 48 can be independently secured to ceiling 12 by fitting a suitable screw through one or more of openings 51 provided in base 50. In this case removal of screw 20 will release from the assembly track or ceiling clips 14 and track 16.

Also, it can be appreciated that should it be desired to change the valance only, for example, for repair, then valance 40 can readily be disengaged from the assembly without disturbing the track or track or ceiling clips of the assembly.

While a specific embodiment of this invention has been illustrated and described herein, the invention is not limited to the specific construction disclosed. Those skilled in the art may be able to provide modifications or alternatives to the disclosed structural features while still practicing this invention. It is intended to cover all such modifications and alternatives as well as other embodiments not disclosed, which do not constitute a departure from the spirit and scope of the attached claims.

What is claimed is:

1. In a vertical blind assembly comprising a valance clip for securing a valance thereto, said vertical blind assembly comprising brace means, a track portion, and a track clip having means for releasably securing said track portion to said brace means; said valance clip comprising a base for securing said clip to said assembly between said track clip and said brace means, and an elongate portion extending from said base and integral therewith, said elongate portion biased to urge same against said brace means for releasably securing said valance therebetween.

2. A vertical blind assembly according to claim 1 wherein said elongate portion of said valance clip is spring biased to urge said elongate portion against said brace means.

3. A vertical blind assembly according to claims 1 or 2 wherein said valance clip is positioned beneath said brace means.

4. A vertical blind assembly according to claims 1 or 2 wherein said base of said valance clip is secured to said brace means.

5. A vertical blind assembly according to claims 1 or 2 wherein said base of said valance clip is secured to said assembly between said track clip and said brace means such that said base is in abutting relation along one side thereof with said track clip and in abutting relation along the opposing side thereof with said brace means.

6. A vertical blind assembly according to claim 1 wherein said brace means is a ceiling.

7. A vertical blind assembly according to claim 6 wherein said elongate portion of said valance clip is spring biased to urge said elongate portion against said ceiling.

8. A vertical blind assembly according to claim 6 or 7 wherein said base of said balance clip is secured to said ceiling.

9. A vertical blind assembly according to claims 7 or 8, wherein said base of said valance clip is secured to said assembly between said track clip and said brace means such that said base is in abutting relation along one side thereof with said track clip and in abutting relation along the opposing side thereof with said brace means.

10. A vertical blind assembly according to claims 6 or 7 wherein said assembly is secured to said ceiling.

11. A method for securing a valance to a vertical blind assembly comprising the steps of:

(i) securing the base of a valance clip between a track clip of said assembly and a suitable brace means with said base in abutting relation along one side thereof with said track clip and in abutting relation along the opposing side thereof with said suitable brace means, and with an elongate biased portion of said valance clip extending outwardly from said base with said biasing directed to urge said elongate portion of said valance clip against said brace means;

(ii) securing to said track clip a track; and (iii) securing between said biased elongate portion of said valance clip and said brace means said valance.

12. A method according to claim 11 wherein a plurality of valance clips are secured by their respective bases between a plurality of track clips and a suitable brace means in spaced-apart relation to one another, and said plurality of valance clips are oriented with their respective elongate biased portions extending outwardly from their respective bases in the same direction and with said biasing directed to urge said respective elongate portions of said plurality of valance clips against said brace means.

13. A method for securing a valance to a vertical blind assembly comprising the steps of:

(i) securing the base of a valance clip between a track clip of said assembly and a ceiling with said base in abutting relation along one side thereof with said track clip and in abutting relation along the opposing side thereof with said ceiling, and with an elongate biased portion of said valance clip extending outwardly from said base with said biasing directed to urge said elongate portion of said valance clip against said ceiling;

(ii) securing to said track clip a track; and (iii) securing between said biased elongate portion of said valance clip and said ceiling said valance.

14. A method according to claim 13 wherein a plurality of valance clips are secured by their respective bases between a plurality of track clips and a ceiling in spaced-apart relation to one another, and said plurality of valance clips are orientated with their respective elongate biased portions extending outwardly from their respective bases in the same direction and with said biasing directed to urge said respective elongate portions of said plurality of valance lips against said ceiling.

* * * * *